United States Patent [19]

Bishop

[11] 4,456,072

[45] Jun. 26, 1984

[54] ICE ISLAND STRUCTURE AND DRILLING METHOD

[76] Inventor: Gilbert H. Bishop, 800 E. Ocean Blvd., Suite 801, Long Beach, Calif. 90802

[21] Appl. No.: 373,976

[22] Filed: May 3, 1982

[51] Int. Cl.[3] ..... E21B 7/00; E02D 19/04

[52] U.S. Cl. ..... 166/362; 405/217; 405/61; 175/9

[58] Field of Search ..... 405/217, 61, 259, 260, 405/227, 224, 226; 166/362, 366; 175/9, 7; 114/230, 293, 144 B; 52/98, 97

[56] References Cited

U.S. PATENT DOCUMENTS

| | | | |
|---|---|---|---|
| 2,248,051 | 7/1941 | Armstrong | 175/9 X |
| 2,308,743 | 1/1943 | Bulkley et al. | 175/9 X |
| 3,191,201 | 6/1965 | Richardson et al. | 114/114 B |
| 3,552,343 | 1/1971 | Scott | 114/144 B |
| 3,738,114 | 6/1973 | Bishop | 405/217 |
| 3,742,715 | 7/1973 | Nolte | 405/61 |
| 3,837,752 | 9/1974 | Shewchuk | 52/98 X |
| 4,325,656 | 4/1982 | Bishop | 405/217 |

FOREIGN PATENT DOCUMENTS

| | | | |
|---|---|---|---|
| 0075010 | 6/1980 | Japan | 405/217 |

*Primary Examiner*—Ernest R. Purser

*Assistant Examiner*—Michael Starinsky

*Attorney, Agent, or Firm*—Fulwider, Patton, Rieber, Lee & Utecht

[57] ABSTRACT

An off-shore ice island structure for location over a submerged drill site in waters which normally freeze in winter. The structure includes a buoyant protective caisson which freezes in position over the drill site upon onset of winter. A barge floats on water kept unfrozen within the caisson, and is connected to the caisson so it can be swivelled generally about a vertical axis to adjust the circumferential location of the drilling axis of drilling apparatus carried on the barge. The drilling apparatus is movable relative to the barge to enable further adjustment of the drilling axis location. The arrangement enables the drilling axis to be maintained in substantial vertical alignment with the drill site despite movement of the caisson caused by the surrounding shelf ice. The caisson is part of an ice island structure whose mass is built up by successive flooding and freezing steps to ground it on the sea bed. The capability for fixing the location of the drilling axis despite shelf ice movement permits drilling operations to commence long prior to grounding of the ice island.

Various arrangements are disclosed for moving the barge from within the caisson for reuse at another drill site.

23 Claims, 14 Drawing Figures

FIG. 1
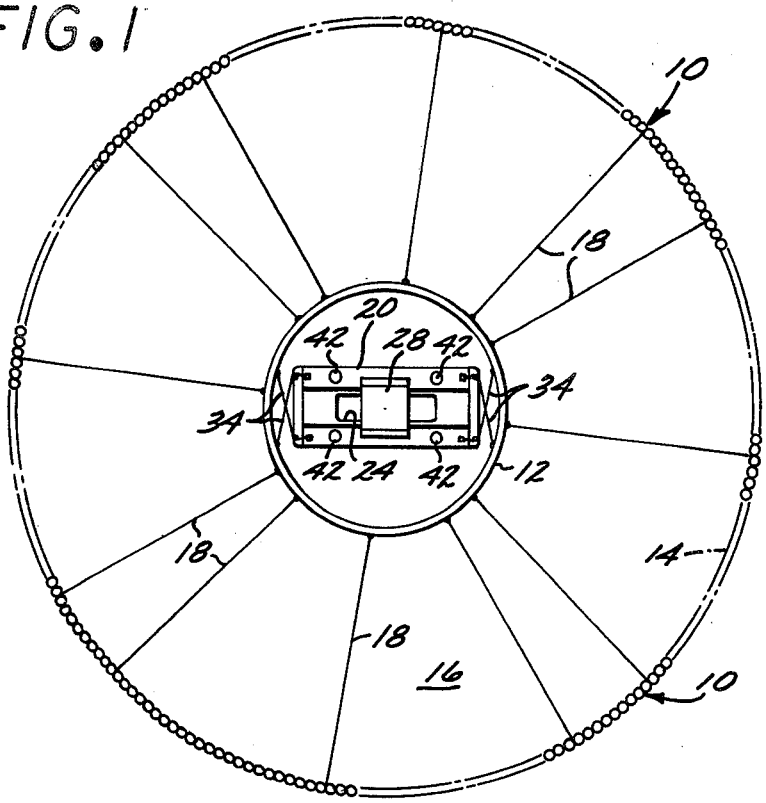
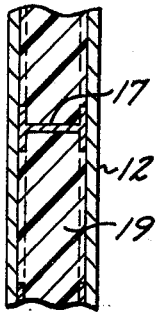
FIG. 4
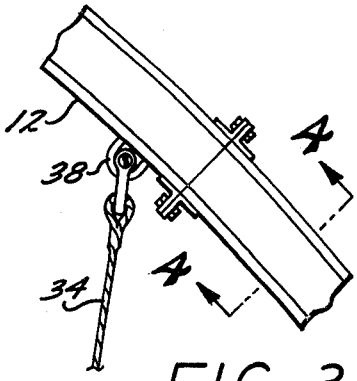
FIG. 3
FIG. 2
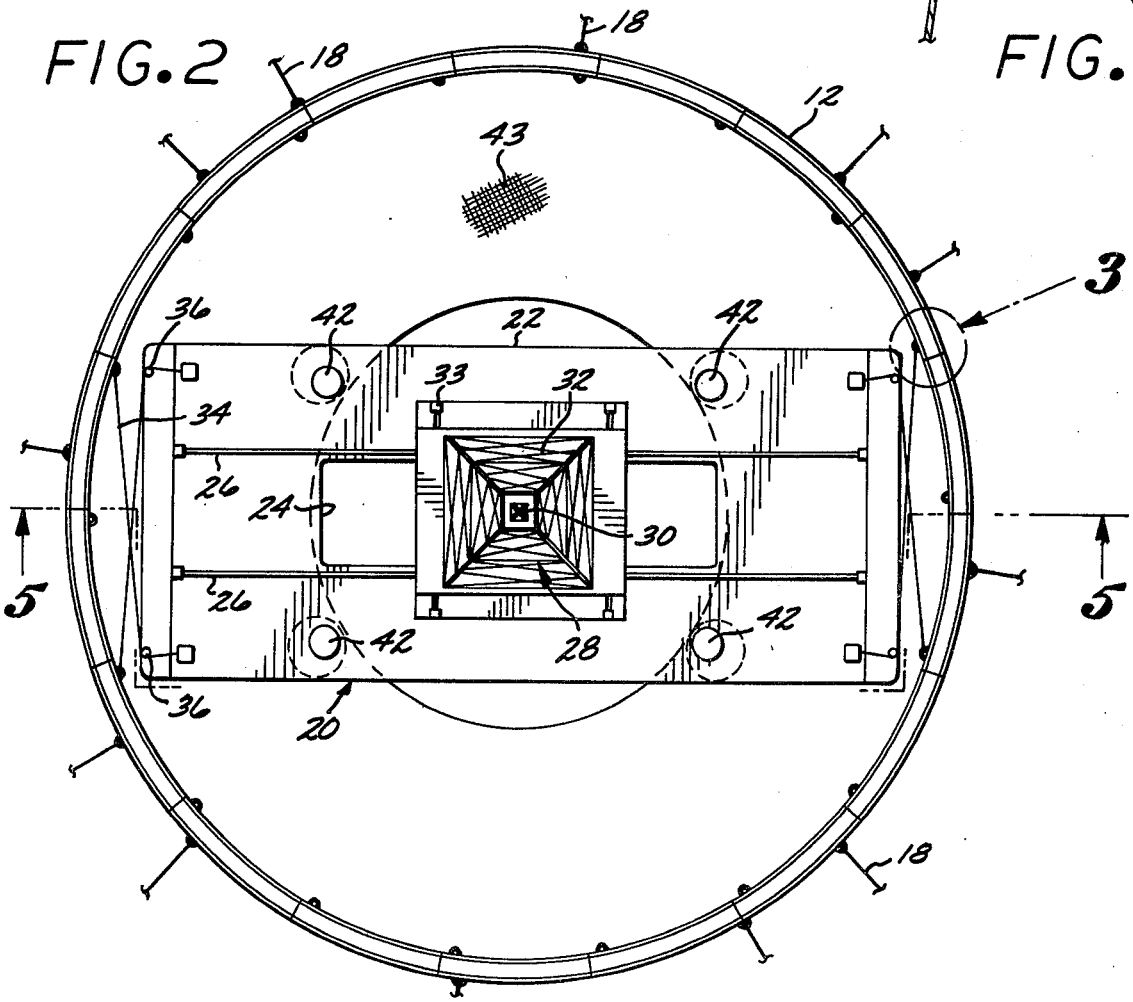

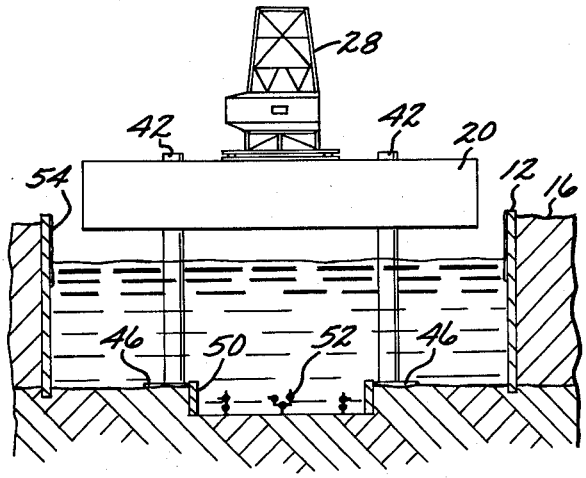
FIG. 9
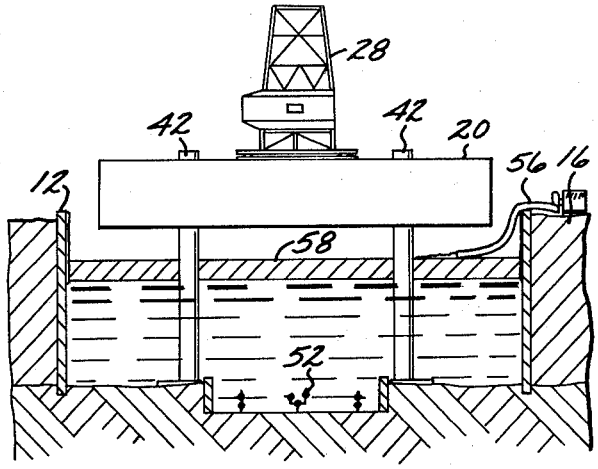
FIG. 10
FIG. 11
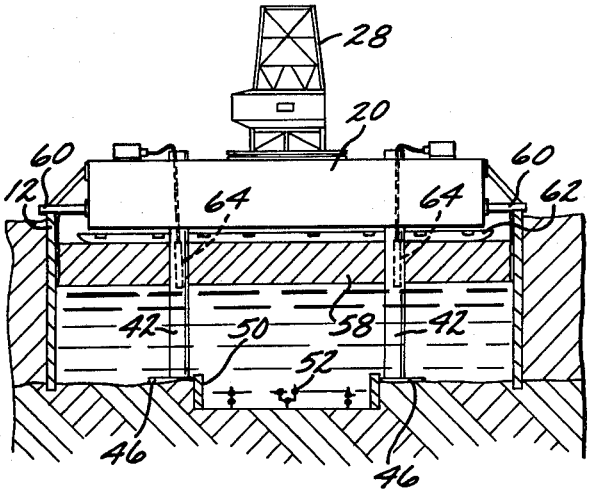
FIG. 12
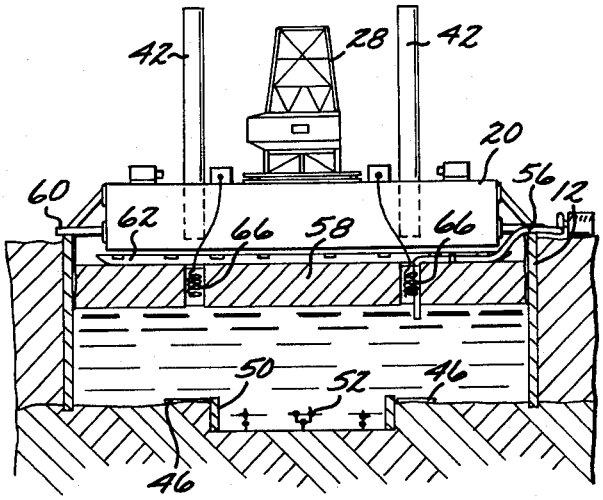
FIG. 13
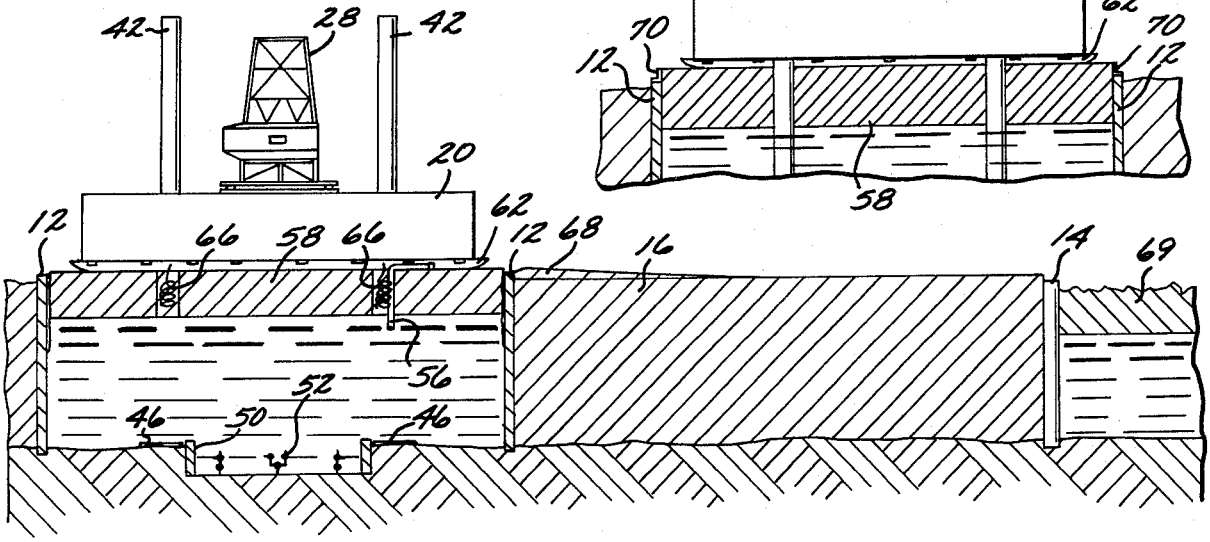
FIG. 14
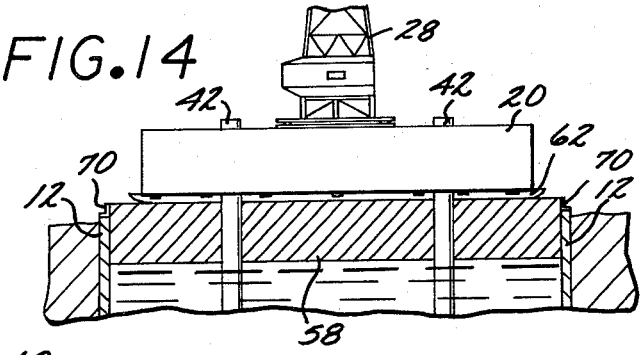

ICE ISLAND STRUCTURE AND DRILLING METHOD

BACKGROUND OF THE INVENTION

1. Field of the Invention

The present invention relates to an ice island structure for location over a submerged drill site in offshore waters, and to a drilling method utilizing the ice island structure for drilling prior to grounding of the ice island structure upon the sea bed.

2. Description of the Prior Art

One method advanced in the prior art for oil drilling off the coast of Alaska utilizes a floating barge as the drilling platform. However, if the barge is allowed to become frozen into the shelf ice, drilling must be suspended until the next year.

In my U.S. Pat. No. 3,738,114, entitled "Method and Apparatus for Forming Ice Island for Drilling or the Like," issued June 12, 1973, a method and apparatus is disclosed for forming an ice island on natural ice, and increasing its mass and height until it is grounded with sufficient freeboard to enable its use as a secure and immovable base for drilling. The method and apparatus involve location of a drilling barge at the offshore drill site during a thaw period. The barge freezes in the shelf ice at the onset of winter, and concentric, spaced apart inner and outer walls are constructed around the barge on the shelf ice. The shelf ice space between the walls is repeatedly flooded and allowed to freeze until the weight of the ice mass causes it to sink and ground upon the sea bottom. Extensions are added to the walls to maintain adequate freeboard as the sinking proceeds. This securely fixes the position of the ice island so that drilling operations can take place without danger of the drill pipe being wedged or sheared away by movement of the surrounding shelf ice.

One difficulty with the foregoing method and apparatus is that construction of the ice island was necessarily delayed until the surrounding ice had frozen thick enough to support the weight of the inner and outer walls and the usual construction and assembly equipment. This shortened the period of time during the winter which could be utilized to pump in and freeze water to build up the mass of the ice island. In my U.S. patent application, Ser. No. 167,931, filed July 14, 1980, now U.S. Pat. No. 4,325,656 entitled "Apparatus and Method for Forming Offshore Ice Island Structure," I show an improved method and apparatus for forming an ice island which uses buoyant inner and outer walls which can be assembled in open water. Naturally forming ice locks in the inner and outer walls in fixed relationship and provides a base enabling layered flooding and freezing in the annular space between the walls. Layers of ice, approximately two to three inches per day, are built up to increase the mass of the ice island and gradually cause it to sink. During such sinking extensions are added to the walls to maintain adequate freeboard.

The ice mass growth or accumulation is continued until sufficient excess weight is developed to ground the island and resist the lateral forces encountered on fixed shelf ice break-up. In a typical twenty foot water depth, such excess weight is achieved with an ice island approximately thirty feet high, which would provide about ten feet of freeboard.

The desired excess weight and proper freeboard is reached much earlier in the winter season than was possible with the method and apparatus of my patent, enabling earlier use of the island for drilling or other applications.

Unfortunately, none of the foregoing systems of the prior art provide a means for drilling prior to grounding of the ice island, without exposing the drilling equipment to possible damage because of movement of adjacent shelf ice.

SUMMARY OF THE INVENTION

In one embodiment of the present invention, buoyant concentric inner and outer walls form part of an offshore ice island structure and are connected together and located over a drill site in waters which normally freeze in the winter. The frozen area between the inner and outer walls is flooded, the water is allowed to freeze, and the process repeated, with upper extensions periodically being added to the walls. The natural buoyancy of ice maintains a freeboard area upon which the layers of water can be added, and the weight of the accumulated ice eventually sinks the island and grounds or rests it solidly upon the sea bottom.

According to the present invention, drilling can begin long prior to such grounding. Drilling can begin when the fixed ice shelf is about six inches thick, which is normally attained by mid-November. For this purpose a jack-up barge is located inside the inner wall when it is first assembled. The barge preferably includes an elongated central portion or "moon" pool opening to the sea.

Usual drilling apparatus rides on skids or tracks straddling the pool for changing the position of the drilling apparatus along the length of the pool. In addition, flexible coupling of the floating barge to the inner wall permits the barge to be swiveled about a vertical axis for changing the circumferential position of the drilling apparatus. Consequently, the location of the drilling axis, which extends downwardly through the pool, can be adjusted to compensate for any movement of the ice island caused by movement of the surrounding shelf ice under the influence of wind and tide.

The shelf ice shift experienced in many areas of the Alaskan North Slope region, which is a region of particular interest, is small enough that the compensating adjustment of the drilling axis provided by the present apparatus is ample. As a result, drilling can begin very early in the winter season without danger of loss of the drill string prior to grounding of the ice island. Further, if drilling core tests proves the area to be unproductive prior to grounding, drilling can be discontinued and the ice buildup of the island continued until the island is just short of grounding. The island can then be moved by tugs during the next thaw to a more promising location in deeper waters. The existing mass plus the ice accumulated in the second cold season permit grounding of the island in the deeper waters leaving an undisturbed natural seabed.

The floating barge preferably includes vertically oriented jack-up legs having lower openings with lift pumps and conduit means to pump water out of the tops of the legs and onto the frozen area between the inner and outer walls. The legs are movable downwardly to engage the sea bottom and support the barge for use as a convenient working platform. Water can then be pumped from within the inner wall to permit construction of a permanent sub-seabed work pit. This protects valving and transfer piping from damage by any natural or artificial structure which passes over the work pit. In addition, it enables the ice island to be later moved to another location with minimum sea bed clearances over the work pit area, preserving maximum island growth commensurate with flotation.

A sub-seabed cover is preferably used to protect valving in the sub-surface work pit, including the usual blowout preventer.

The ice island structure also may include a means to enable the barge to be moved to a new drill site independently of the grounded ice island. To accomplish this, the inner wall area is flooded below the suspended barge, and upper layer of water is allowed to freeze to form an ice plug. The barge legs are then jacked up to lower the barge onto a sledge placed on the ice plug, the leg openings in the plug are closed off, and water is pumped into the inner wall below the plug to hydraulically raise the plug and the barge to a position enabling the barge to be sledged onto the adjacent surface of the ice island for transport elsewhere. In another method, upper extensions are made to the inner wall, the barge is jacked to a level higher than the extensions, support elements are attached to the inner wall to extend below the barge, the inner wall is flooded to cover the support elements, and the water is frozen in a plug at the level of the wall extensions. The barge legs are jacked up to lower the barge onto a sledge placed on the frozen plug, and the support elements transfer most of this load to the inner wall extensions. The barge is thereafter sledged onto the surrounding ice island surface and then skidded over the outer protective wall onto the ice-snow build-up on the weather side of the outer wall.

Other objects and features of the invention will become apparent from consideration of the following detailed description taken in connection with the accompanying drawings.

BRIEF DESCRIPTION OF THE DRAWINGS

FIG. 1 is a plan view of the present ice island structure as the same would appear with the floating barge in operating position;

FIG. 2 is an enlarged partial plan view of the inner wall of the ice island structure, particularly illustrating the floating barge and the drilling apparatus carried by the barge;

FIG. 3 is an enlarged view taken along the line 3—3 of FIG. 2;

FIG. 4 is an enlarged view taken along the line 4—4 of FIG. 3;

FIG. 9 is a view similar to FIG. 6, but illustrating the barge raised upon its supporting legs, and the inner wall flooded;

FIG. 10 is a view similar to FIG. 9, and illustrating freezing of water within the inner wall to form an ice plug;

FIG. 11 is a view similar to FIG. 10, illustrating the fully formed ice plug, and lowering of the barge onto a sledge located on the ice plug;

FIG. 12 is a view similar to FIG. 11, illustrating the barge supported upon the inner wall, the barge legs raised, the leg openings closed with ice, and water being injected into the area below the ice plug;

FIG. 13 is a view similar to FIG. 12, illustrating hydraulic raising of the plug to ready the barge for sledging onto the adjacent ice island surface; and FIG. 14 is a view similar to FIG. 13, illustrating another means for forming an ice plug for sledging the barge onto the adjacent ice island surface, in this case the ice plug being frozen onto support elements carried by the outer wall for supporting the weight of the barge.

DESCRIPTION OF THE PREFERRED EMBODIMENT

Figure 5:
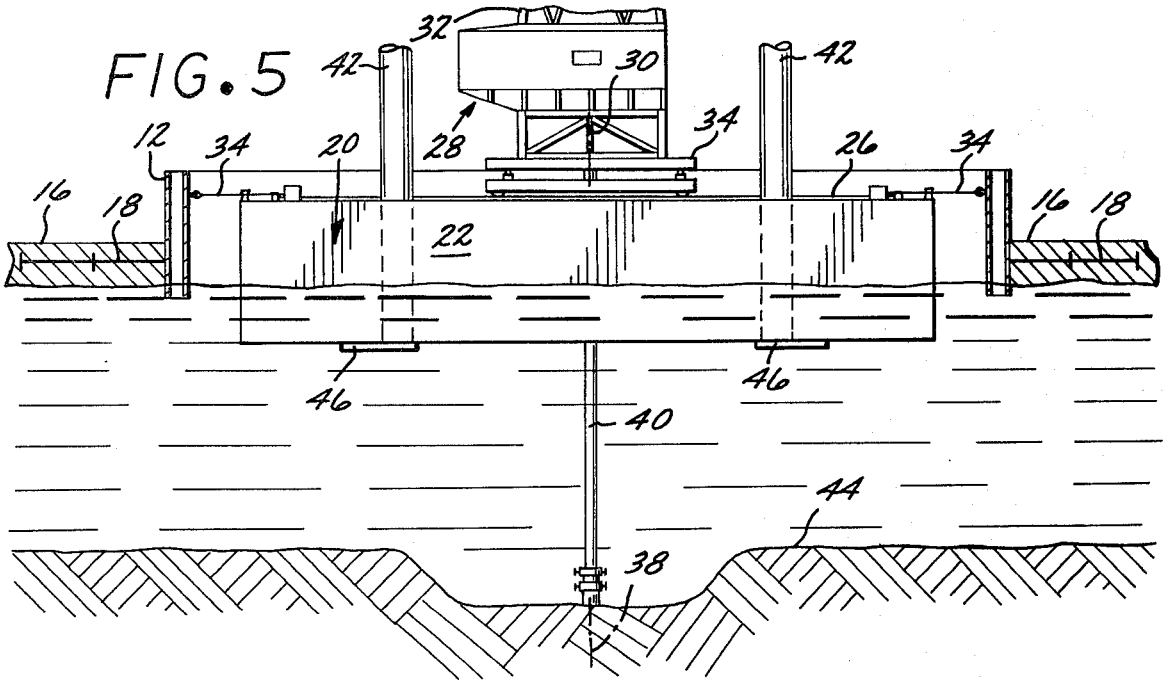
FIG. 5 is a view taken along the line 5—5 of FIG. 2.

Referring now to the drawings, there is illustrated an ice island structure 10 for use in gaining access to offshore oil and the like in cold regions such as north of 70 degrees north latitude, and particularly the North Slope of Alaska. The structure 10 comprises, generally, concentric, peripherally continuous and vertically oriented inner and outer caissons or walls 12 and 14, respecively, defining an intervening annular space 16.

As more particularly described in my copending patent application Ser. No. 167,931, filed Jan. 14, 1980, and entitled "Apparatus and Method for Forming Offshore Ice Island Structure," the space 16 is the area within which water is frozen layer upon layer to form an ice island for use as a platform for drilling equipment, storage tanks, power supplies, refrigeration and heating equipment, pumping equipment, and other necessary working tools. The island can also be used as a ship docking facility, or to store off-loaded materials for later transport to shore, or for use as a processing or storage base for negative temperature liquefaction hydrocarbons.

As seen in FIGS. 3 and 4, the inner wall 12 is made of sections of edge connected sandwich structure comprising spaced apart, relatively heavy plate steel reinforced with a plurality of vertically oriented I-beams 17, and is filled with thermal insulating material 19. The wall 12 is connected by cables 18 to the outer wall 14 to stabilize and fix the relative locations of the walls.

Although the size and freeboard of the ice island structure 10 will vary according to the particular application and the depth of water within which it is to be located, the inner diameter of the wall 12 in one embodiment is approximately 300 feet. A typical drill site would be about four to seven miles offshore in approximately 3 to 4 fathoms. This size of wall is ample to accommodate a floating barge 20, provide room for a working crew to cap the well or wells that are drilled, and also provide access to the sea bottom for construction of a work pit, as will be seen.

The inner wall 12 preferably includes internal compartments in its lower portion to provide buoyancy. The wall is fabricated at some convenient work site remote from the planned location of the ice island, and is assembled around the barge 20 in the open sea at the drill site.

The outer wall 14 is also buoyant and it is assembled in surrounding relation and connected to the inner wall 12. Its diameter depends upon the mass and area of ice necessary to firmly hold the island in position once it is grounded. This will be a function of the coefficient of friction of the sea bottom, and the ice-shelf shift forces. As is well known in the art, the ice mass of the grounded island will draw heat from the sea bed and thus transform the sea bed into a rigid permafrost condition, thereby increasing resistance of the ice island to any ice shelf lateral shift forces. In the embodiment illustrated, the diameter is approximately 1,000 feet, the final height being sufficient to extend from the bottom and provide freeboard gravitational weight sufficient to overcome any lateral forces which may be encountered. In most close inshore locations, a minimum of 5 to 10 feet of freeboard is desirable to shelter the barge 20 and other equipment from the forces of wind, sea, and ice thaw shift. If desired, the outer wall 14 could be angled on the ice encroachment side to aid in fracturing shelf ice into blocks through uplift upon the angled surface.

The open sea assembly or fabrication of the buoyant inner and outer walls 12 and 14 greatly simplifies the logistics of commencing construction of the ice island structure 10 before the onset of winter, thereby enabling maximum utilization of the full ten month cold season typical in arctic regions for rapidly freezing water to form the island. Although the phrase "open sea" is used, the assembly of the ice island structure could be delayed until thin shelf ice has formed, and has become fixed in position, in which case the wall components could be punched through such thin shelf ice by any suitable means. If anchorage of the walls to the sea bottom is permitted, drilling could begin immediately. Thus, drilling can begin as soon as the walls are fixed in position, either by anchorage or by being frozen in fixed position in the shelf ice. If the applicable drilling laws and regulations permit early drilling, the walls 12 and 14 could be assembled in open water in September and anchored to the sea bottom. If early drilling is not permitted, shelf ice begins to form in October and drilling can begin in early November when the ice is about 6 inches thick.

Figure 6:
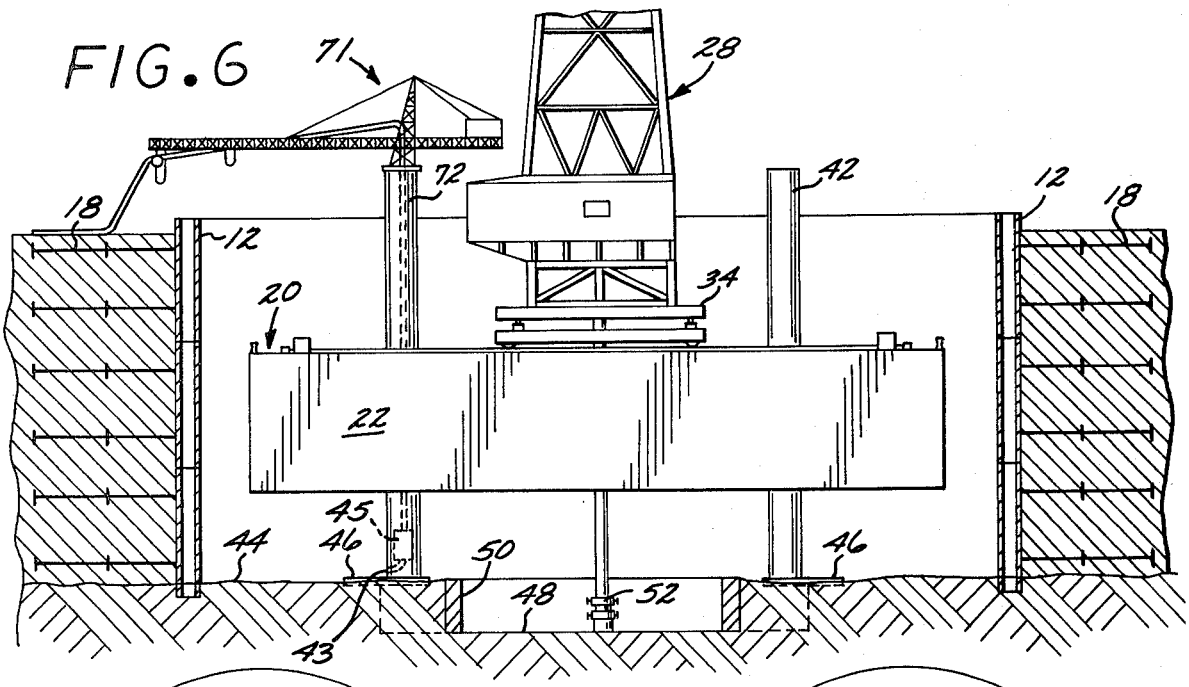
FIG. 6 is a view similar to FIG. 5, but illustrating the grounded ice island structure, and the barge supported on its legs within the ice island inner wall.

The floating barge 20 is preferably made approximately 290 feet long and, as best seen in FIGS. 2, through 6, comprises a buoyant, compartmented hull 22 provided with living quarters for workmen, food stores, drill water storage, fuel tanks, maintenance and repair rooms, and all of the other necessities for surviving and working in the rigorous arctic regions. The barge hull 22 is characterized by a rectangular, elongated opening or moon pool 24 which is open to the sea. It is approximately 126 feet long and 30 feet wide. Longitudinally extending skids or tracks 26 are arranged on opposite sides of the opening 24.

A drilling apparatus 28 is located on the tracks 26 and is longitudinally movable along the tracks 26 by any suitable means (not shown) whereby the drilling axis 30 of a drill rig 32 can be located anywhere along the length of the moon pool 24. The apparatus 28 also includes a cross carriage 33 which enables the apparatus to be moved laterally across a portion of the width of the pool 24.

Figure 7:
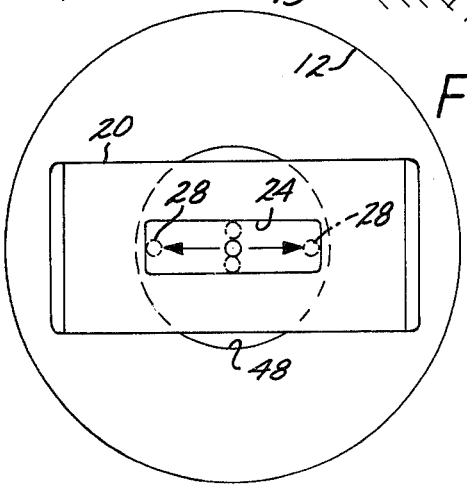
FIG. 7 is a diagrammatic plan view of the floating barge, particularly illustrating axial moveability of the drilling apparatus.

The barge 20 is secured to the inner wall 12 by any suitable means, such as by crossed cables or wires 34 extending through fairleads 36 located at the corners of the barge hull 22. The wires 34 at each end of the barge hull 22 intersect, as seen in FIG. 2, and are connected to suitable pad eyes 38 carried by the inner wall 12, as seen in FIG. 3. With this arrangement, selective winching of certain ones of the wires 34 will swivel the barge 180 degrees in opposite directions, as shown diagrammatically in FIG. 8. This capability for adjusting the circumferential location of the drilling axis 30, in combination with the longitudinal and lateral adjustment of the location of the drilling axis 30, as seen in FIG. 7, permits the drill rig 32 to be utilized for drilling wells anywhere within an area approximately 200 feet in diameter. As will be seen, and equally important advantage of the adjustability of the location of the drilling axis 30 is that the drilling of a first well can commence as soon as it is cold enough to lock the ice island structure 10 in position relative to the surrounding fixed shelf ice.

As more fully explained in my co-pending patent application Ser. No. 167,931, once the shelf ice has formed sufficiently to anchor the ice island structure 10 in position, there are approximately seven months of sub-zero temperature remaining to build up and ground the structure 10.

If the island is to be provided with a relocation capability, refrigeration coils (not shown) are laid down, with support hangers (not shown) extending upwardly for bracing by superjacent ice build-up. Sea water at approximately 29 degrees Fahrenheit is pumped from within the inner wall 12 through openings 43 in the base of one or more of four legs 42 of the barge 20, and by means of pumps 45, also located in the legs. Preferably, a cantilever tower crane 71 is carried atop each of the legs (only one of which is illustrated in FIG. 6) and supports distribution hoses 72 which extend into the guadrants, respectively, of the annular space 16 to distribute sea water for ice formation, as required.

The water is pumped or flooded onto the surface of the area 16 in a thin layer by any suitable equipment (not shown). This is allowed to freeze, and the process is repeated to build up the height of the ice mass. An average of two to three inches of ice buildup takes place each day so that a 30 to 40 foot high ice mass can be built up in a typical cold season at the North Slope.

The ice mass is built up in a shallow dome shape (not shown) so that excess brine can flow outwardly for removal by sweeper-scrapers (not shown). Flexible hose or plastic covered cable, (not shown) can be used to form temporary dikes or dams 2 to 3 inches high to contain the water for freezing and to help concentrate leached out brine for removal by the sweeper-scrapers. This provides a denser, harder ice for better structural rigidity. Upper extensions are added to the walls 12 and 14 as necessary, and additional interconnecting bracing 18 is installed between the built up walls 12 and 14 for embedment in the formed ice. This process is normally continued until the island grounds upon the sea bottom, and is continued still further to insure a firm anchorage. The weight of the island, and particularly the freeboard mass will constrain it against lateral shifting under the shelf ice forces common in the North Slope region. However, long prior to grounding, and preferably immediately after the structure 10 first becomes frozen into the shelf ice, drilling is begun. This can be as early as November in the North Slope region, as previously indicated, since six inches or more of natural fixed ice form by November 15 between Pt. Barrow and Canada on the Beaufort sea shelf within the 10 fathom curve.

The water within the inner wall 12 is kept from freezing by placing insulating material, such as styrofoam blankets and chips on the surface, as schematically indicated at 43 in FIG. 2, and by discharging into it the heated water used for cooling equipment on the barge 20. The insulation 19 in the inner wall 12 aids in keeping the inner wall area ice free, and thermodynamic factors prevent loss of residual heat downwardly.

In the North Slope region of Alaska, typical movement of the fixed ice shelf due to tide and weather is slow and amounts to less the 30 feet in an approximately east-west direction, and somewhat less in a north-south direction during the fall and winter seasons.

The ice island structure 10, and particularly the drilling axis 30 of the drilling apparatus 28, is initially located in vertical alignment with the drill site axis 38, as best seen in FIG. 5. Suitable sensors (not shown) are employed to detect movement of the shelf ice. If such movement is detected after the drill 40 of the drill rig 32 has penetrated the ocean bottom, the barge 20 is swiveled and the drilling apparatus 28 is moved longitudinally and laterally in an amount sufficient to compensate for such shelf ice movement. This process of adjustment continues as long as necessary to maintain alignment of the axes 30 and 38. If the drilling does not prove to be productive, the ice island structure 10 need not be fixedly grounded, but could be moved during the next thaw period by tugs or the like to a more promising location after removal of some freeboard weight.

If the drilling appears promising, the ice island mass is built up to firmly ground it, as seen in FIG. 6. The anchor or swivel wires 34 are uncoupled, and the water, insulation and any ice within the wall 12 are cleared out.

The four jack legs 42 of the barge 20 are jacked down to support the barge in the position illustrated in FIG. 6. The jack means for operating the jack legs 42 are well known in the prior art and their description is omitted for brevity. The bottoms of the legs preferably include relatively large diameter pads or feet 46 which engage the sea bed in an increased area to distribute the weight of the barge and lessen penetration of the bottom by the legs 42. Such penetration could interfere with sub-seabed construction, as will be seen. Such feet 46 are made separable and for this purpose are connected to the legs 42 by shear pins or the like. If desired, the legs 42 can then be pulled up independently of the feet 46, as will be seen.

Once the area bounded by the inner wall 12 is cleared of water and ice, a work pit 48 is excavated to a depth of approximately 20 feet below the sea bed 44. A caisson 50 is cemented in around the perimeter of the pit 48, and around the usual blow out preventer (BOP) 52 and associated valving which are already established on the preliminary well below the sea bed 44. The area enclosed by the caisson 50 is leveled and a foundation floor is laid to support bracing for additional wells, and to support a suitable protective cover.

Figure 8:
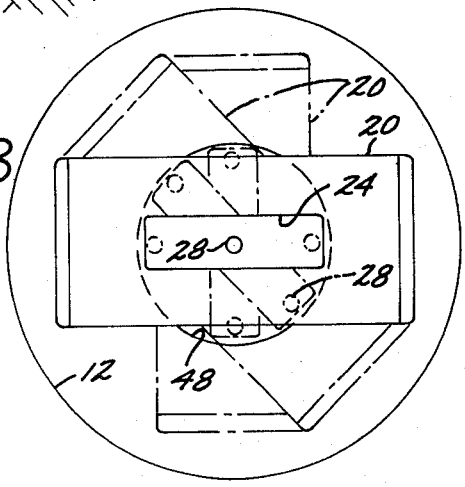
FIG. 8 is a view similar to FIG. 7, particularly illustrating the swiveling capability of the barge to adjust the circumferential position of the drilling axis.

If additional wells are to be drilled, four or more may be drilled, two on each side of the original well, by fore and aft skidding of the drilling apparatus. If still more wells are to be drilled, then the area within the inner wall 12 is flooded by pumping water from outside through one or more conduits 72, FIG. 6, and through the leg openings 43 until the barge is refloated. The barge 20 is then reconnected to the wall 12 by the swivel wires 34 and then located in position for drilling the additional wells, as schematically indicated in FIG. 8. In a 200 foot work pit 48 as many as 20 to 26 wells can be drilled using the procedure previously described for the first well.

In the event that drilling is completed and it is desired to move the barge 20 independently of the ice island to another drill site for use with another ice island structure the area within the inner wall 12 is flooded, as seen in FIG. 10. One method of moving the barge comprises covering the upper portion of the inner wall 12 with a temporary plywood and plastic membrane or barrier 54 to provide a low friction surface on approximately the upper eight feet of the wall. Next, the barge 20 is jacked up on its legs 42 to the position shown in FIG. 9.

The upper layer of water within the flooded inner wall is allowed to freeze, against the membrane barrier 54, and a layer of water is then pumped onto the upper surface of the frozen layer by pumping means 56, as seen in FIG. 10. After this freezes the process is continued until an ice plug 58 is formed, as seen in FIG. 13.

Heavy, laterally extending support elements 60 are disposed between the ends of the barge 20 and the upper edge of the adjacent inner wall 12 to support the barge 20 in its raised position. Skid timbers or a sledge 62 are next placed on the ice plug 58 beneath the barge 20. The barge is then lowered onto the sledge 62.

Suitable heaters, hot oil injectors, or steam injectors 64 located within the legs 42 are operated to thaw one or two inches of the ice surrounding the legs 42. The legs 42 are then jacked up to the position illustrated in FIG. 12, the weight of the barge 20 being borne primarily by the inner wall 12 through load transfer from the support elements 60. Raising of the legs 42 is facilitated by separating and jettisoning the leg bases or feet 46, as by shearing of the shear pins (not shown).

Refrigeration coils 66 are placed in the leg openings left in the ice plug 58 by the raised legs 42, and the outlet conduit of the pumping means 56 is disposed downwardly through one of the leg openings so that water can be pumped into the area below the ice plug 58. The coils 66 freeze and plug the leg openings so that water cannot flow upwardly through them. Operation of the pumping means 56 hydraulically pressurizes the area beneath the ice plug 58 and raises the plug 58, sledge 62, and barge 20 to the position illustrated in FIG. 13. Sliding of the periphery of the plug 58 past the upper portion of the inner wall 12 is facilitated by the presence of the plywood and plastic barrier 54.

The sledge 62 and barge 20 can now be moved laterally by tractors or the like (not shown) to the surrounding surface of the ice island structure. Temporary ramps 68 of ice and snow are built up adjacent the inner wall 12, a suitable width of the outer wall 12 is removed to the level of the surrounding shelf ice, and the intervening ice island surface between the inner wall and the outer wall opening is sloped to permit the barge to be sledged onto the surrounding shelf ice 69. During the next spring thaw, the barge 20 can then be floated to another drill site.

Another and preferred method of sledging the barge 20 out of the area bounded by the inner wall 12 is illustrated in FIG. 14. In this method upper extensions 70 are connected to the upper edges of the existing inner wall 12, and the barge 20 is raised on its legs 42 to a position above the extensions 70. The area within the wall 12 is alternately flooded and frozen to form an ice plug which is fixedly frozen to and supported by the wall 12. This plug 58 is now located at the level of the ice surface between the walls 12 and 14.

The sledge 62 is placed on the ice plug 58 and the barge 20 is then lowered onto the sledge.

As before, the support elements 60, not seen in FIG. 14, are disposed between the barge 20 and the upper edge of the extensions 70 to support the barge upon the extensions during raising of the legs 42. The heaters (not shown) in the legs 42 are operated to melt the ice immediately adjacent the legs 42, and the legs 42 are jacked up or raised above the ice plug 58. Use of refrigeration coils is unnecessary to plug the leg openings. The barge 20 can then be sledged onto the surrounding ice island surface for transport to another drill site.

The foregoing ice island structure and drilling methods permit drilling very early in the winter. This saves one full season and makes maximum utilization of the opportunity not only to form the ice island, but also to drill. Under present regulations such drilling in the North Slope region must terminate on a particular deadline in the Spring, and it appears that more than one well could easily be drilled prior to this deadline date using the described system, as compared with the systems of the prior art. Further, the present system also makes it possible to abandon a drill site prior to grounding of the ice island if stratographic logging and core results of the first drilling proves to be unproductive. Of environmental interest is the fact that such abandonment leaves a clean, undisturbed natural sea-bed surface.

Details respecting preservation of the ice island structure during the thaw season, or relocation of the ice island during the thaw season, are set forth in my U.S. Pat. No. 3,738,114.

Various modifications and changes may be made with regard to the foregoing detailed description without departure from the spirit of the invention.

I claim:

1. Ice island structure for location over a submerged drill site in waters which normally freeze in winter, said ice island structure being adapted to be increased in mass to ground said structure upon the sea bottom, said ice island structure comprising:

inner wall means adapted to be surrounded by shelf ice during the onset of winter to fix the position of said inner wall means relative to said shelf ice, and wherein water and ice may be removed from within said inner wall means on grounding to afford access to the sea bottom;

a floating barge located within said inner wall means, said barge including a plurality of legs downwardly extendable from said barge for engagement with the sea bottom for support of said barge above the sea bottom;

drilling apparatus carried by said barge and having a drilling axis, said drilling apparatus being movable on said barge whereby the location of said drilling axis is adjustable; and swivel means on said barge coupled to said inner wall means and operative to swivel said barge about a vertical axis for adjusting the circumferential location of said drilling axis during floating of said barge whereby said drilling axis can be maintained in substantial vertical alignment with said drill site despite shifting of said shelf ice.

2. Ice island structure according to claim 1 wherein said barge includes an elongated portion open to the sea and through which said drilling axis extends, said drilling apparatus being adjustably movable along the length of said elongated portion.

3. Ice island structure according to claim 1 and including means for pumping water through said legs.

4. Ice island structure according to claim 3 and including feet separably carried at the bottoms of said legs, respectively, and characterized by an area, in a horizontal plane, larger than that of said legs, said feet being selectively separable upon raising of said legs from the sea bottom.

5. Ice island structure for location over a submerged drill site in waters which normally freeze in winter, said ice island structure being adapted to be increased in mass to ground said structure upon the sea bottom, said ice island structure comprising:

inner wall means adapted to be surrounded by shelf ice during the onset of winter to fix the position of said inner wall means relative to said shelf ice, and wherein water and ice may be removed from within said inner wall means on grounding to afford access to the sea bottom;

a floating barge located within said inner wall means, said barge including a plurality of legs downwardly extendable from said barge for engagement with the sea bottom for support of said barge above the sea bottom;

means for pumping water through said legs;

drilling apparatus carried by said barge and having a drilling axis, said drilling apparatus being movable on said barge whereby the location of said drilling axis is adjustable;

swivel means on said barge operative to swivel said barge about a vertical axis for adjusting the circumferential location of said drilling axis whereby said drilling axis can be maintained in substantial vertical alignment with said drill site despite shifting of said shelf ice; and means for reflooding the space within said inner wall means to refloat said barge whereby said swivel means and drilling apparatus may be operated to adjust the location of said drilling axis over a new site adjacent the first drill site.

6. Ice island structure according to claim 5 and including membrane means disposed over the upper inner surface off said inner wall means; means for flooding the space within said inner wall means for formation of an ice plug adjacent said membrane means; and heating means in said legs to thaw ice adjacent said legs whereby said legs may be raised through the ice plug.

7. Ice island structure for location over a submerged drill site in waters which normally freeze in winter, said ice island structure being adapted to be increased in mass to ground said structure upon the sea bottom, said ice island structure comprising:

concentric inner and outer wall means interconnected to define an intervening annular space and adapted to be surrounded by shelf ice during the onset of winter to fix the position of said inner wall means relative to said shelf ice, and wherein water and ice may be removed from within said inner wall means on grounding to afford access to the sea bottom;

a floating barge located within said inner wall means and including a plurality of jack-up legs and further including an elongated moon pool downwardly open to the sea;

means for pumping successive layers of water at regular intervals on top of the shelf ice within said annular space, through an upright conduit in at least one of said jack up legs, whereby water is enabled to drop out of said conduit on cessation of said pumping, and whereby said layers are enabled to freeze and form an ice island mass for grounding upon the sea bottom;

drilling apparatus carried by said barge above said moon pool for drilling along a drilling axis extending downwardly through said moon pool, said drilling apparatus being movable on said barge whereby the location of said drilling axis is adjustable; and swivel means carried by said barge, connected to said inner wall means, and operative to swivel said barge about a vertical axis for adjusting the circumferential location of said drilling axis during floating of said barge whereby said drilling axis can be maintained in substantial vertical alignment with said drill site despite shifting of said shelf ice.

8. Ice island structure according to claim 7 wherein the conduit of said means for laying successive layers of water extends upwardly and out of the top of at least one of said jack-up legs, and then laterally and downwardly for water discharge.

9. Ice island structure according to claim 7 and including means for discharging heated cooling water from equipment on said barge to prevent water within said inner wall means from freezing.

10. Ice island structure according to claim 7 wherein said inner and outer wall means are buoyant for interconnection in the open sea.

11. An ice island structure drilling method comprising the steps of:

locating a floating barge over a submerged drill site it waters which normally freeze in winter, said barge having depending legs;

locating an inner wall means around said barge and allowing said inner wall means to be frozen into shelf ice during the onset of winter to fix the position of said inner wall means relative to said shelf ice;

connecting said barge to said inner wall means and adjusting the location of said barge to adjust the location of drilling apparatus on said barge relative to said inner wall means;

adjusting the location of said drilling apparatus relative to said barge whereby the drilling axis of said drilling apparatus can be maintained in substantial vertical alignment with said drill site despite shifting of said shelf ice; and increasing the mass of said ice island structure to ground said ice island structure upon the sea bottom; and jacking down said legs to suspend said barge above the sea bottom.

12. The method of claim 11 wherein the location of said drilling apparatus relative to said inner wall means is achieved by swivelling said barge about a substantially vertical axis.

13. The method of claim 11 and including the steps of reflooding the space within said inner wall means; raising said barge on said legs to a position above the flooded water level; allowing the surface water to freeze; successively flooding the frozen surface water at intervals to build up an ice plug; placing sledge means on said ice plug; lowering said barge onto said sledge means; raising said legs above said ice plug and closing the leg openings against upward water flow; and pressurizing the space below said ice plug to raise said ice plug to a level enabling said barge to be sledged onto the adjacent surface between said inner and outer wall means.

14. The method of claim 11 and including the steps of adding an upper extension to said inner wall means; reflooding the space within said inner wall means to a level just below said upper extension; raising said barge on said legs to a position above said level; allowing the surface water to freeze; successively flooding the frozen surface water at intervals to build up an ice plug for freezing onto the inner surfaces of said upper extension; placing sledge means on said ice plug; lowering said barge on said sledge means; raising said legs above said ice plug; and sledging said barge onto the adjacent surface between said inner and outer wall means.

15. An ice island structure drilling method comprising the steps of:

locating a floating barge over a submerged drill site in waters which normally freeze in winter, said barge having depending legs;

locating concentric inner and outer wall means around said barge and allowing said inner and outer wall means to be frozen into shelf ice during the onset of winter to fix the position of said inner wall means relative to said shelf ice;

connecting said barge to said inner wall means and adjusting the location of said barge and drilling apparatus on said barge relative to said inner wall means whereby the drilling axis of said drilling apparatus can be maintained in substantial vertical alignment with said drill site despite shifting of said shelf ice;

flooding the space between said inner and outer wall means through at least one depending leg with layers of water at intervals enabling the water to freeze and build an ice island of sufficient mass to ground upon the sea bottom, and simultaneously adding upward extensions of said inner and outer wall means to contain said mass; and jacking down said legs to suspend said barge above said sea bottom to afford access to said sea bottom.

16. The method of claim 15 including the step of insulating the surface layer of water in the space within said inner wall means to constrain it from freezing.

17. The method of claim 15 wherein said inner and outer wall means are buoyant and are located around said barge in the open sea prior to formation of said shelf ice.

18. The method of claim 15 and including the step of drilling with said drilling apparatus simultaneously with the build-up of said ice island mass and prior to grounding thereof.

19. The method of claim 15 wherein said water is pumped from within said inner wall means through conduit means located in at least one of said legs.

20. The method of claim 15 and including the step of drilling a well, the step of forming a work pit extending below the level of the sea bottom and around the drill site, and the step of installing valving equipment on the well head.

21. An ice island structure drilling method comprising the steps of:

locating a floating barge over a submerged drill site in waters which normally freeze in winter;

locating concentric inner and outer wall means around said barge and allowing said inner and outer wall means to be frozen into shelf ice during the onset of winter to fix the position of said inner wall means relative to said shelf ice;

connecting said barge to said inner wall means and adjusting the location of said barge and drilling apparatus on said barge relative to said inner wall means whereby the drilling axis of said drilling apparatus can be maintained in substantial vertical alignment with said drill site despite shifting of said shelf ice;

flooding the space between said inner and outer wall means with layers of water at intervals enabling the water to freeze and build an ice island of sufficient mass to ground upon the sea bottom, and simultaneously adding upward extensions of said inner and outer wall means to contain said mass;

clearing water and ice from within said inner wall means upon grounding of said ice island mass;

downwardly extending legs from said barge to suspend said barge above the sea bottom; and reflooding the space within said inner wall means to refloat said barge, and adjusting the location of said barge and drilling apparatus relative to said inner wall means to locate said drilling axis over a new drill site adjacent the first drill site.

22. The method of claim 13 and including the step of heating the ice adjacent said legs to facilitate their withdrawal through said ice plug.

23. The method of claim 13 and including the step of applying a separating membrane structure to the inner surface of the upper portion of said inner wall means prior to said reflooding step to facilitate upward movement of said ice plug relative to said inner wall means.

* * * * *